US009008346B2

(12) United States Patent
Kolton

(10) Patent No.: US 9,008,346 B2
(45) Date of Patent: Apr. 14, 2015

(54) ARTICULATING HEADPHONES WITH BIASED ARM POSITIONS

(71) Applicant: Timothy Val Kolton, Hollywood, CA (US)

(72) Inventor: Timothy Val Kolton, Hollywood, CA (US)

( * ) Notice: Subject to any disclaimer, the term of this patent is extended or adjusted under 35 U.S.C. 154(b) by 0 days.

(21) Appl. No.: 13/970,955

(22) Filed: Aug. 20, 2013

(65) Prior Publication Data

US 2015/0055815 A1 Feb. 26, 2015

(51) Int. Cl.
*H04R 25/00* (2006.01)
*H04R 1/10* (2006.01)

(52) U.S. Cl.
CPC ..... *H04R 1/1066* (2013.01); *H04R 1/105* (2013.01)

(58) Field of Classification Search
USPC ..... 381/370–374, 377–383
See application file for complete search history.

(56) References Cited

U.S. PATENT DOCUMENTS

| | | | | | |
|---|---|---|---|---|---|
| 1,133,833 | A | * | 3/1915 | Adams-Randall | 381/378 |
| 1,483,315 | A | * | 2/1924 | Saal | 381/378 |
| 1,546,566 | A | * | 7/1925 | Childress | 381/378 |
| 1,592,978 | A | * | 7/1926 | Kaisling, Jr. | 381/378 |
| 1,649,551 | A | * | 11/1927 | Smith | 381/378 |
| 2,186,072 | A | * | 1/1940 | Huth | 381/74 |

* cited by examiner

*Primary Examiner* — Suhan Ni
(74) *Attorney, Agent, or Firm* — Edwin Tarver

(57) ABSTRACT

A headphone with articulating earpieces includes a headband, a hinged fork, and earpieces connected to the fork in a manner allowing the earpieces to articulate relative to the fork as a hinge on the fork articulates. The earpieces are arranged on the fork in a manner allowing them to face each other while articulating from a folded position adjacent the headband, to an unfolded position for listening. When unfolded for listening, the earpieces are adapted to fully extend into a biased open position with an audible click. Similarly, when articulating the earphones to a closed position, they are biased against the headband with an audible click.

14 Claims, 8 Drawing Sheets

ARTICULATING HEADPHONES WITH BIASED ARM POSITIONS

BACKGROUND

Headphones are known in the art, including headphones with folding earpieces. Typically, these types of folding headphones include earpieces that simply hinge inwardly toward the headband of the headphones. The problem with this arrangement is that the faces of the earpieces are exposed and may be contaminated by dust or other foreign material, and the earpieces frequently touch, which may cause marring or scratching of the earpiece shell.

In response to these problems, headphones have been developed with hinged ear pieces that face each other when folded inward. This is typically accomplished by providing a hinged fork which is able to rotate at least partially around each earpiece. These types of headphones avoid the problem of contamination reaching the face of the earpieces and damage to their sensitive component parts. However they include certain drawbacks including a hinging mechanism which cannot indicate to a user when the earpieces are in an optimally folded or unfolded position, and frequently will not remain in an unfolded position, which causes the earpieces to swing back and forth when not folded together.

The present invention solves these problems by providing headphones with foldable earpieces capable of notifying the user when the earpieces reach a fully folded or unfolded configuration, and which prevents the earpieces, when unfolded, from swinging back and forth. These and other objects of the invention are more fully discussed in the appended summary, description and claims.

SUMMARY

An improved folding headphone includes an arced headband for engaging a user's head, which is resiliently biased to a predetermined position, and connected to earphones for engaging a user's ear. The headband and earphones are each connected together by an articulating member. In a preferred embodiment, the articulating members are forked, allowing them to connect to either side of an earphone, and to the headband.

The articulating members are preferably connected to the earphones by a rotating connection allowing the earphones to rotate relative to the articulating members. In a forked embodiment, two rotating connections will ideally be placed near or substantially at a mid-point of the earphones and the forks formed long enough, so that the earphone can rotate relative to the articulating member without striking the articulating member. In this manner, the earphones can be placed in a pad-to-pad arrangement facing each other within the arced space created by the headband.

The articulating members are connected to the headband by a hinge, which allows them to swing relative to the headband. The hinge connecting the articulating members to the headband, allows them to be biased to an open position when the earphones are pulled down relative to the headband. Likewise, the articulating members may be biased to other positions, such as a closed position. In addition to biasing in various positions, when the articulating member reaches the biased open position or another position, it is engineered to produce an audible sound, such as a click.

The biased positions of the articulating members, in a preferred embodiment are at a limit of range of the hinge, including the two extreme limits of range from an open position, in which the earphones are positioned for covering the ears of a user, to a closed position, wherein the ear phones are articulated up into the concave space of the headband. To provide a balanced range of motion between the earphones and the articulating members, the rotating connection is near a midpoint of an earphone, with two rotating connections on either side of an earphone.

The two rotating connections are joined by a fork in the articulating member, which extends into the headband. In this manner, one earphone or both earphones may be articulated into the concave space created by the headband without changing the orientation of the earphone, and may come to rest with the earphones facing each other. This relationship causes the pads of the earphones to form a semi-seal, and helps prevent debris from entering the earphone. In addition, with two earphones attached to two ends of the headband, respectively, they may be articulated into a concave space created by the headband for compact storage.

Resiliency in the headband preserves the earphones in a folded position when the articulating members are rotated to bring the earphones into the headband. Preferably the earphones are sized to substantially covers a user's ear, and comprise a transducer and other customary earphone components. Additionally, both earphones may include connectors for receiving an input or cord.

In order to use the headphones, a user first obtains a headphone with left and right earphones folded into the concave space of a headband. The user then grasps the headband and articulates the earphones away from the headband. By articulating the earphones away from the headband, the earphones are rotated relative to articulating members connecting the earphones to the headband until hinges on the articulating members reach their extreme limit of movement. At that point they are biased to the open position with an audible click, and a user may place the headphones on the user's head.

REFERENCE NUMBERS

10. Headphone
12. Headphone Case
100. Headband
102. Earpiece
104. Pad
106. Wire
108. Fork
110. Upper Portion
112. Lower Portion
114. Hinged Connection

116. Hinge
118. Hinge Screws
120. First Plate
122. Second Plate
124. Holes
126. Stop
128. Disc Springs
130. Hinge Pin
132. Tab
134. Detent
136. Nut

DESCRIPTION

Figure 1:
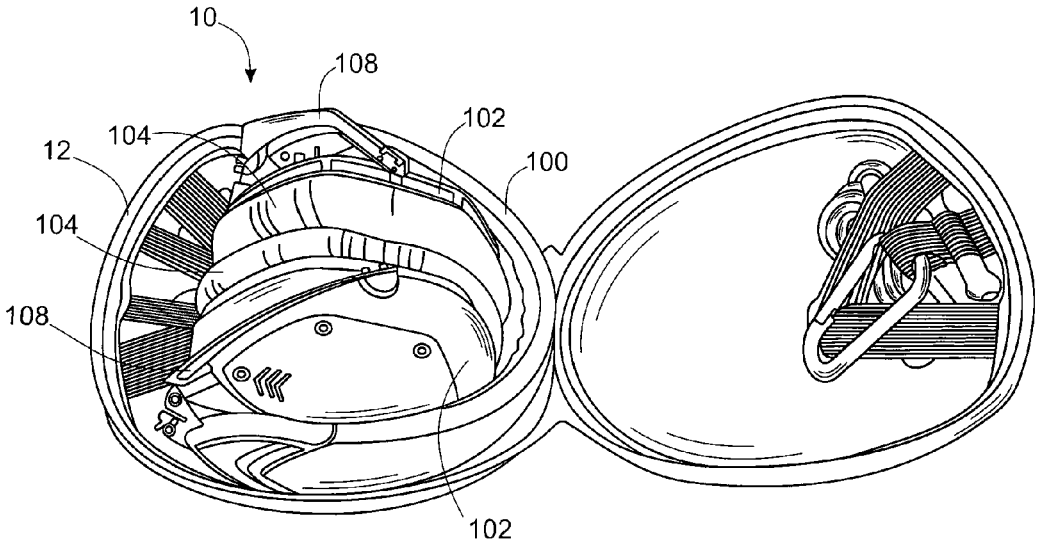
FIG. 1 is a perspective view of articulating headphones placed in a case for storage.

Referring to FIG. 1, an improved folding headphone 10 is adapted to fit inside a headphone case 12 when not in use. Because the headphone 10 is foldable, the size of the headphone case 12 is reduced. As is shown in FIG. 1, the headband 100 is adapted with earpieces 102 that fold inward toward the headband 100. Unlike headphones known in the art however, when the earpieces 102 are folded upward into the headband 100, they retain their orientation with the pads 104 on the earpieces 102 facing each other. This orientation is made possible since the earpieces 102 are held by forks 108 which hold the ear pieces 102 at their sides.

Figure 2:
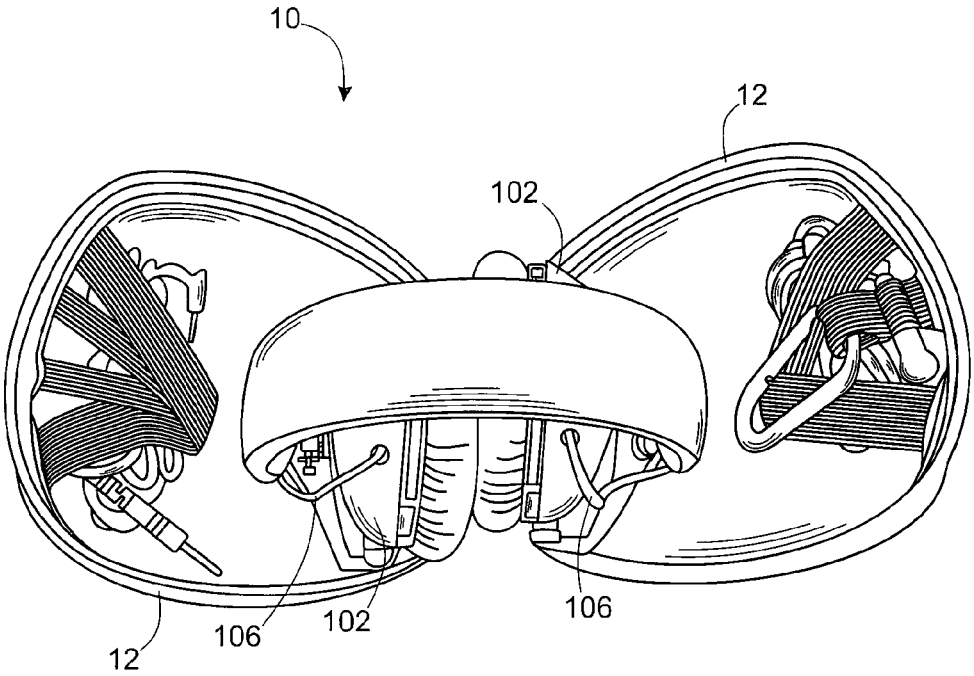
FIG. 2 is a perspective view of the headphones being removed from the case.

Referring to FIG. 2, in order to use the headphones 10, a user begins by removing them from the protective case 12. Because the earpieces 102 are held together by the headband 100, the headphones 10 remain in a folded position. Ideally, the wire 106 for transmitting sound is of an appropriate length to allow the earpieces 102 to rotate relative to the forks 108.

Figure 3:
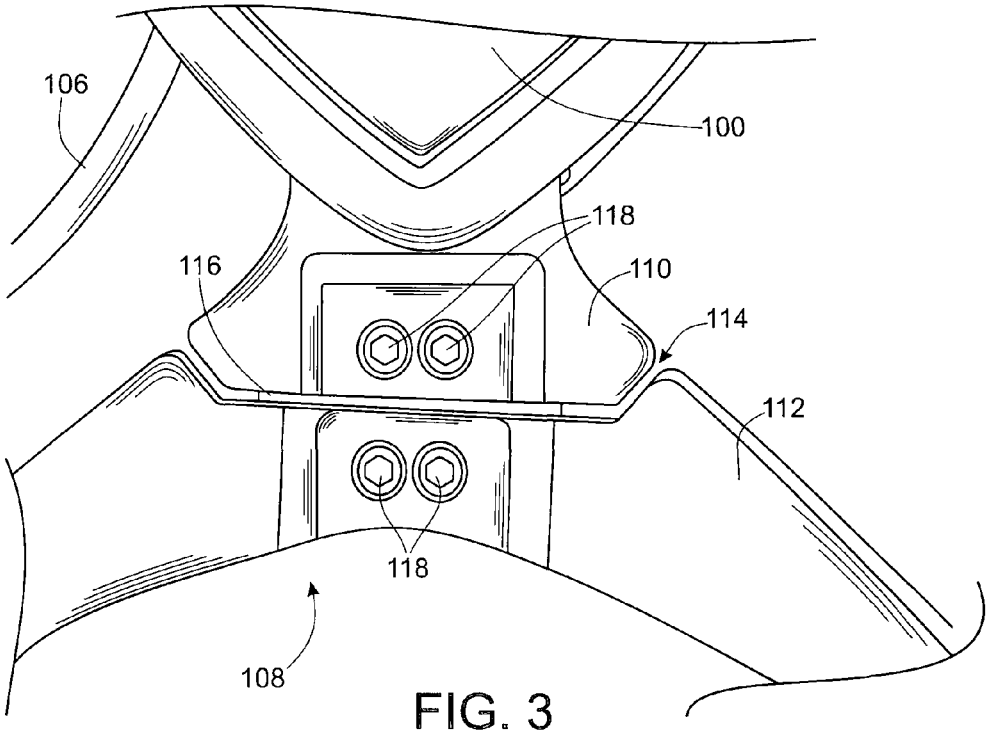
FIG. 3 is an enlarged perspective view of the connection between an articulating member and a headband.

Referring to FIG. 3, in order to bring the ear pieces (not shown) into an arrangement for positioning on a user's head, the ear pieces must be folded down. This is accomplished by virtue of a hinged connection 114 which splits the forks 108 into an upper portion 110 and a lower portion 112. The upper portion 110 is connected to the headband 100 and preferably adjustable by sliding in and out of the headband 100. The lower portion 112 comprises the fork 108 that spits and holds an earpiece. A hinge 116 is disposed at the hinged connection 114, preferably behind the upper portion 110 and lower portion 112 so that it allows the earpieces 102 to fold inward relative to the headband 100, while also being obscured from view. In one embodiment, a series of hinge screws 118 attaches the hinge 116 to the upper portion 110 and lower portion 112.

Figure 4:
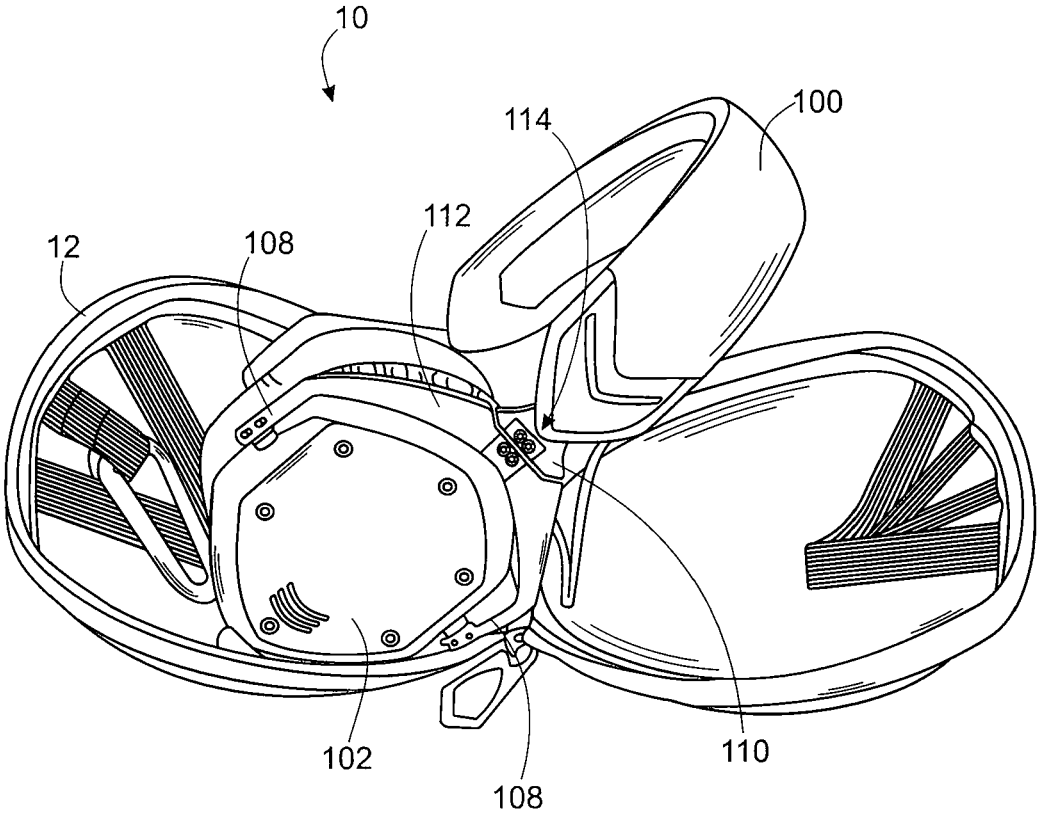
FIG. 4 is a perspective view of articulating headphones with the earphones extended downward into a listening position.

FIG. 4 shows the headphones 10 removed from the headphone case 12 and the earpieces 102 articulated down to allow a user to wear the headphones 10. In this position, the hinged connection 114 brings together the upper portion 110 and lower portion 112 so that they present a uniform appearance from the headband 100 down to the fork 108, thereby resembling a typical set of headphones. As shown, although the hinge screws 118 are shown connecting to the upper portion 110 and lower portion 112, the hinge 116 itself (not shown) is obscured from view.

Figure 5:
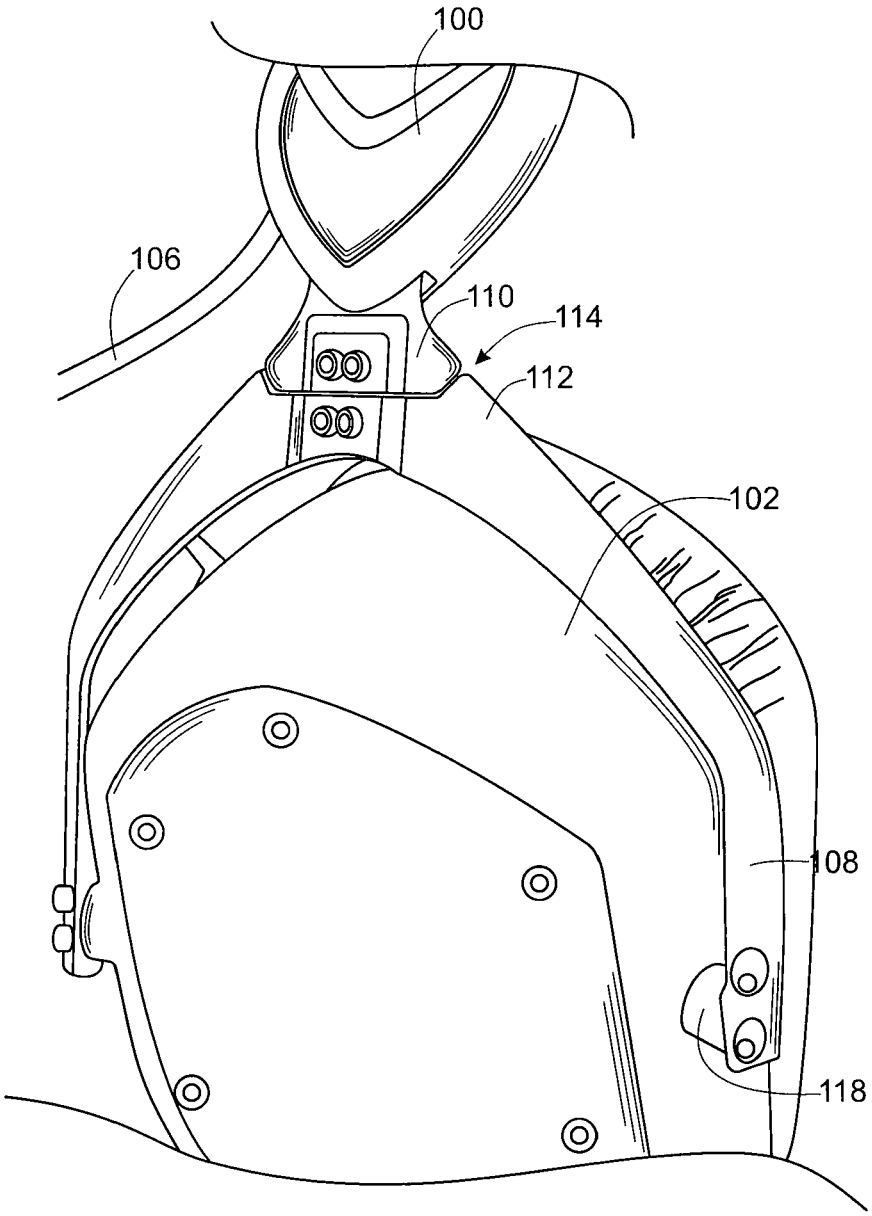
FIG. 5 is an enlarged perspective view of an earphone in a listening position.

FIG. 5 shows a close-up view of the hinged connection 114, and its upper portion 110 and lower portion 112. Also shown at the end of each fork 108 is a fork connector 118, which connect the forks 108 to the earpiece 102. Preferably, the fork connectors 118 are adapted to allow each earpiece 102 to rotate freely between each fork 108. In particular, it is necessary for each earpiece 102 to rotate forward as the hinged connection 114 articulates, so the earpieces 102 can maintain a position facing each other as they move up into the space created by the headband 100.

Figure 6:
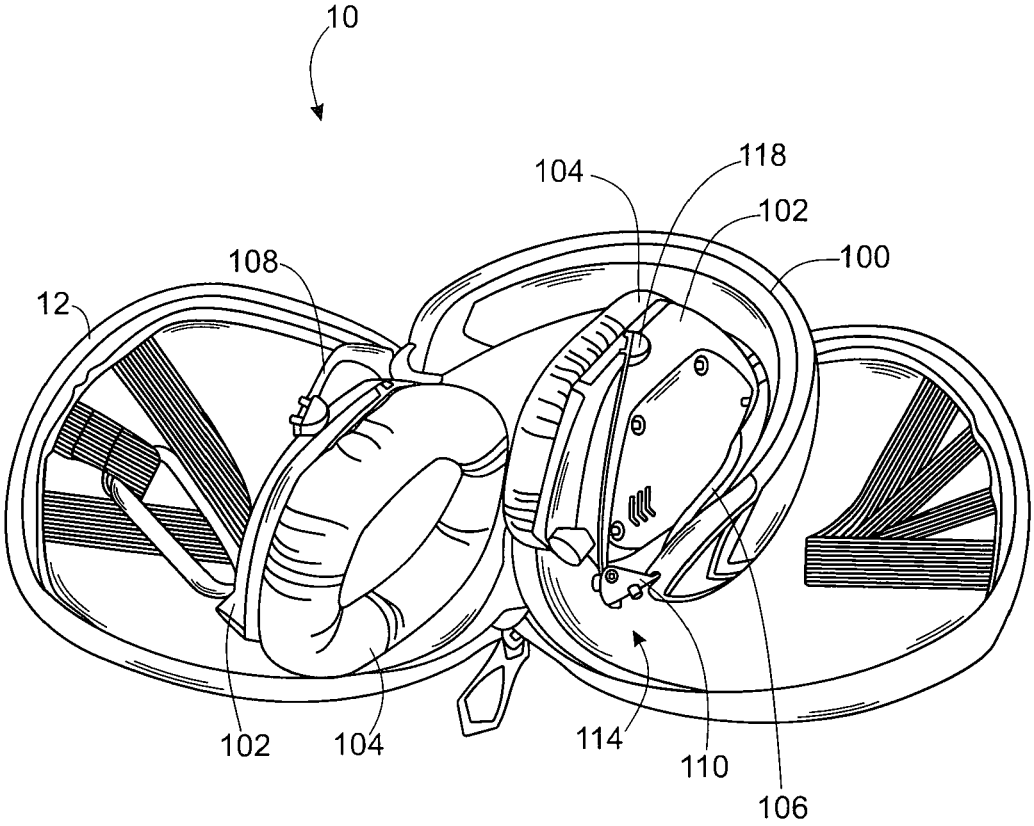
FIG. 6 is a perspective view of articulating headphones with one earphone lowered for listening and another earphone folded for storage.
Figure 7:
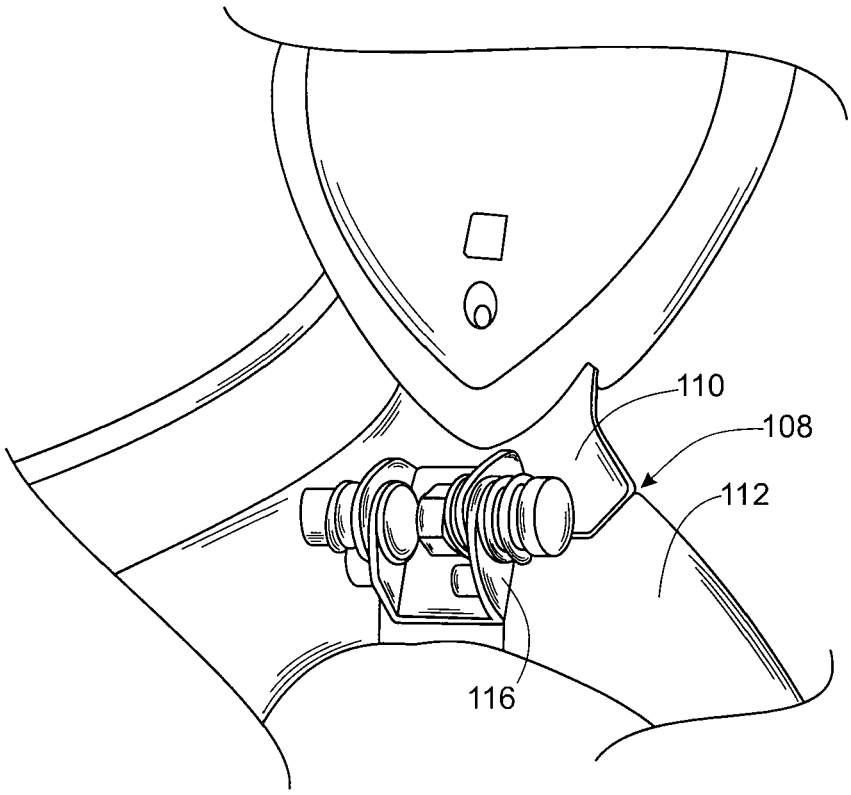
FIG. 7 is a perspective view of a hinge installed on an articulating member.

Referring to FIG. 6, the headphone 10 is shown in the process of being folded back together for storage. As discussed, as the hinged connection 114 is articulated, the earpiece 102 maintains its orientation facing a complimentary earpiece 102. The earpieces 102 may be folded together in unison or independently as shown in the illustrated example. After the earphones 102 are urged out of their biased open position, they smoothly articulate toward the headband 100, until they reach a closed position and are biased to that position with an audible click. The biasing and click sounds are produced by the hinge 116 which connects the upper portion 110 and lower portion 112 of the fork 108. Referring to FIG. 7, the hinge 116 is shown attached to the fork 108. The hinge screws 118 (not shown) connect the hinge 116 to the fork 108.

Figure 8:
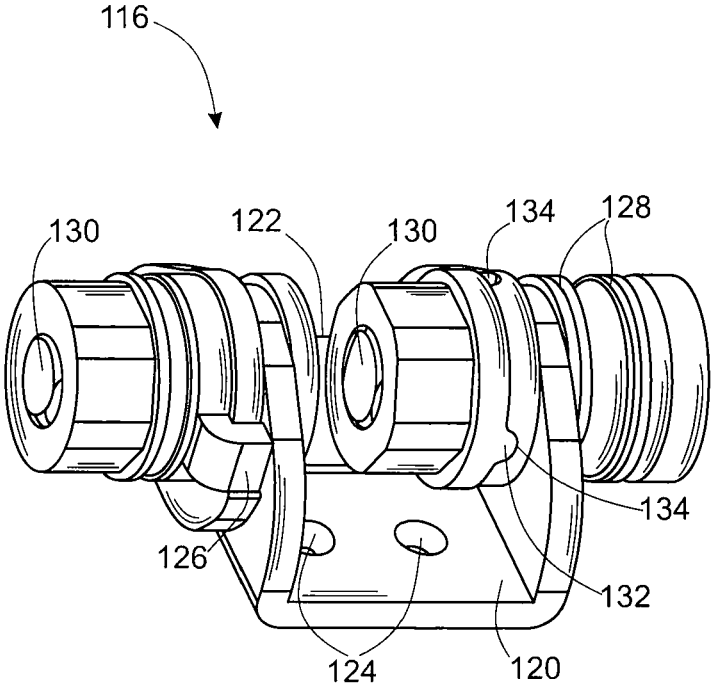
FIG. 8 is a perspective view of the hinge

Referring to FIG. 8, the hinge 116 is illustrated separate from the headphones (not shown). In order to attach to the fork 108 (not shown), the hinge 116 includes a first plate 120 and a second plate 122 for attaching to separate portions of the fork 108. The first plate 120 and second plate 122 each have holes 124 to accommodate fastening screws (not shown). In order to limit the rage of articulating movement of the fork 108, the hinge 116 includes a stop 126 for preventing movement of the first plate 120 past a point where it aligns with the second plate 122.

Still referring to FIG. 8, biasing and audible signaling is accomplished by the hinge 116. A series of disc springs 128 around a hinge pin 130 generates tension in the hinge pin 130. To bias the hinge 116 in a particular position, a tab 132 and a detent 134 are provided in a rotating arrangement, such that in a biased position the tab 132 is disposed in a detent 134 as shown. Tension from the disc springs 128 ensures that the tab 132 is retained in the detent 134, thereby biasing the hinge 116 to a specific position. Also, tension provided by the disc springs 128 causes the tab 132 to "click" into position with an audible sound. Adjustments to the tension of the hinge 116 may be made by tightening or loosening a nut 136 affixed to the hinge pin 130.

In order to use the headphone 10, a user simply removes is from its case 12, articulates the earpieces 102 away from the headband 100. The fork 108 allows the earpieces to articulate relative to the fork 108 until they are fully extended. When the earpieces 102 are fully extended, the tabs 132 on the hinges 126 will seat in the detents 134 with an audible "click" and remain biased in the detents 134 by virtue of the disc springs 128. One use of the headphone 10 concludes, the user simply re-folds the earpieces 102 back into the headband 100, and optionally, may enclose the headphone 10 in its case 12.

The foregoing description of the preferred embodiment of the Invention is sufficient in detail to enable one skilled in the art to make and use the invention. It is understood, however, that the detail of the preferred embodiment presented is not intended to limit the scope of the invention, in as much as equivalents thereof and other modifications which come within the scope of the invention as defined by the claims will become apparent to those skilled in the art upon reading this specification.

What is claimed is:

1. A headphone comprising:

a resiliently arced headband for engaging a user's head;

an earphone for engaging a user's ear;

an articulating member connecting the headband to the earphone;

a rotating connection between the articulating member and the earphone; and a hinge connecting the articulating member to the headband, the hinge having a detent, a tab complimentary to the detent, and wherein the tab is biased to engage the detent to preserve the earphone in a wearable position.

2. The headphone of claim 1 wherein when the articulating member reaches the biased open position, it produces an audible sound.

3. The headphone of claim 2 wherein when the audible sound is a click.

4. The headphone of claim 1 wherein the wearable position corresponds to a stop limiting the range of the hinge.

5. The headphone of claim 1 wherein the rotating connection is near a midpoint of an earphone.

6. The headphone of claim 1 wherein an earphone has two rotating connections.

7. The headphone of claim 1 wherein two rotating connections are joined by a fork in the articulating member.

8. The headphone of claim 1 wherein an earphone may be articulated into a concave space of the headband without changing the orientation of the earphone.

9. The headphone of claim 1 wherein two earphones attached to two ends of the headband, respectively, may be articulated into a concave space created by the headband for compact storage.

10. The headphone of claim 9 wherein resiliency in the headband preserves the earphones in position.

11. The headphone of claim 1 wherein the earphone substantially covers a user's ear.

12. The headphone of claim 1 wherein the earphone comprises a transducer.

13. A headphone comprising:

a resilient headband and two earphones connected to the headband by articulating members;

the articulating members attached to the earphones by rotating connections and attached to the headband by hinges;

the articulating members each having a fork of a predetermined length, terminating in a rotating connection affixed to an earphone; and wherein the hinge is biased to a position in which the earphones are wearable, and biased to a position in which the earphones are folded adjacent the headband, with the earphones maintain the same orientation in either the wearable or folded positions.

14. A headphone comprising:

a deformably resilient headband for engaging a user's head;

an earphone for engaging a user's ear;

an articulating member connecting the headband to the earphone;

a rotating connection between the articulating, member and the earphone; and a hinge connecting the articulating member to the headband, wherein the hinge includes a stop preventing the hinge from articulating past a biased stop position.

* * * * *